US006790339B2

(12) United States Patent
Bulan et al.

(10) Patent No.: US 6,790,339 B2
(45) Date of Patent: Sep. 14, 2004

(54) PROCESS FOR THE ELECTROCHEMICAL PREPARATION OF CHLORINE FROM AQUEOUS SOLUTIONS OF HYDROGEN CHLORIDE

(75) Inventors: Andreas Bulan, Langenfeld (DE); Fritz Gestermann, Leverkusen (DE); Hans-Dieter Pinter, Wermelskirchen (DE); Gerd Speer, Burscheid (DE)

(73) Assignee: Bayer Aktiengesellschaft, Leverkusen (DE)

( * ) Notice: Subject to any disclaimer, the term of this patent is extended or adjusted under 35 U.S.C. 154(b) by 148 days.

(21) Appl. No.: 10/207,937

(22) Filed: Jul. 30, 2002

(65) Prior Publication Data

US 2003/0024824 A1 Feb. 6, 2003

(30) Foreign Application Priority Data

Aug. 3, 2001 (DE) ..... 101 38 215

(51) Int. Cl.[7] ..... C25C 1/02

(52) U.S. Cl. ..... 205/620; 205/618; 205/621; 205/633; 205/636

(58) Field of Search ..... 205/618, 620, 205/621, 633, 636

(56) References Cited

U.S. PATENT DOCUMENTS

| | | | | |
|---|---|---|---|---|
| 4,105,515 A | * | 8/1978 | Ogawa et al. | 205/338 |
| 4,311,568 A | * | 1/1982 | Balko | 205/621 |
| 5,770,035 A | | 6/1998 | Faita | |
| 6,135,331 A | * | 10/2000 | Davis | 223/114 |
| 6,149,782 A | | 11/2000 | Allen et al. | 204/290.14 |

* cited by examiner

*Primary Examiner*—Wesley A. Nicolas
(74) *Attorney, Agent, or Firm*—Joseph C. Gil; Gary F. Matz

(57) ABSTRACT

The invention relates to a process for the electrochemical preparation of chlorine from aqueous solutions of hydrogen chloride in an electrolysis cell, comprising an anode chamber and a cathode chamber, the anode chamber being separated from the cathode chamber by a cation exchange membrane, the anode chamber containing an anode and the cathode chamber a gas diffusion cathode, and the aqueous solution of hydrogen chloride being passed into the anode chamber and an oxygen-containing gas into the cathode chamber, and the oxygen pressure in the cathode chamber being at least about 1.05 bar.

10 Claims, 1 Drawing Sheet

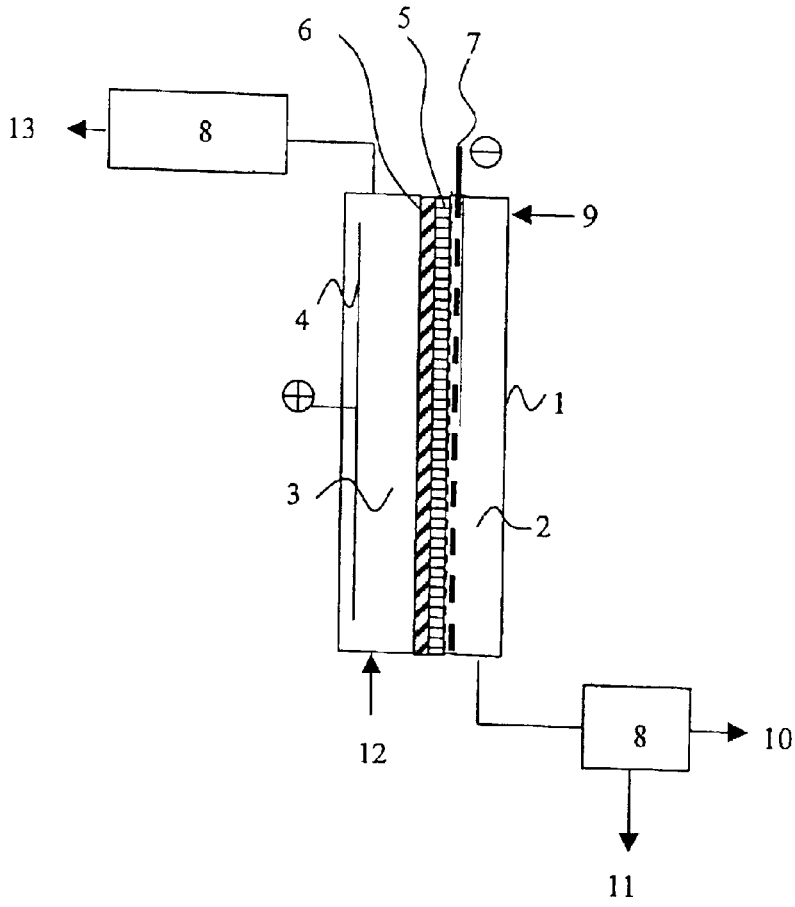
6
5
7
13
8
9
4
1
3
2
12
8
10
11

PROCESS FOR THE ELECTROCHEMICAL PREPARATION OF CHLORINE FROM AQUEOUS SOLUTIONS OF HYDROGEN CHLORIDE

BACKGROUND

The invention relates to a process for the electrochemical preparation of chlorine from aqueous solutions of hydrogen chloride in an electrolysis cell.

Aqueous solutions of hydrogen chloride (hydrochloric acids) are obtained, for example, as byproducts in the preparation of organic chlorine compounds by chlorination with elemental chlorine. Many of these organic chlorine compounds are intermediates for the industrial production of plastics. The aqueous hydrogen chloride solutions obtained have to be utilized. They are preferably utilized by preparing chlorine again from the aqueous solutions of hydrogen chloride, which chlorine can then be used, for example, for further chlorinations.

The reaction to chlorine can be effected, for example, by electrolysis of the aqueous solutions of hydrogen chloride at a gas diffusion cathode. A corresponding process is disclosed in U.S. Pat. No. 5,770,035. According to U.S. Pat. No. 5,770,035, the electrolysis is effected in an electrolysis cell having an anode space, with a suitable anode, for example a noble metal-coated or noble metal-doped titanium electrode, which cell is filled with the aqueous solution of hydrogen chloride. The chlorine formed at the anode escapes from the anode space and is fed to a suitable working-up stage. The anode space is separated from a cathode space by a commercial cation exchange membrane. On the cathode side, a gas diffusion electrode rests on the cation exchange membrane. Behind the gas diffusion electrode is a current distributor. An oxygen-containing gas or pure oxygen is usually passed into the cathode space.

The anode space is kept at a higher pressure than the cathode space. As a result, the cation exchange membrane is pressed onto the gas diffusion cathode and this in turn onto the current distributor. The pressure can be adjusted, for example, by means of a liquid seal through which the chlorine gas formed in the anode chamber is passed.

The process disclosed in U.S. Pat. No. 5,770,035 has the disadvantage that a comparatively large amount of hydrogen is formed at the gas diffusion cathode at high current densities, by which in particular current densities greater than 4,000 $A/m^2$ are meant. However, high current densities are necessary for economic reasons when the process is carried out industrially. In addition, a comparatively high voltage is established at high current densities, resulting in high energy consumption.

It is an object of the invention to provide a process for the electrochemical preparation of chlorine from aqueous solutions of hydrogen chloride, as little hydrogen as possible being formed and as low a voltage as possible being established even when working with high current densities.

SUMMARY

The invention relates to a A process comprising electrochemically preparing chlorine from an aqueous solution of hydrogen chloride in an electrolysis cell having (a) at least one anode chamber containing an anode, (b) at least one cathode chamber having (i) an oxygen-consuming cathode and (ii) a pressure that is at least about 1.05 bar, and (c) a cation exchange membrane for separating the anode and the cathode chamber, in which an aqueous solution of hydrogen chloride passes into the at least one anode chamber and an oxygen-containing gas passes into the at least one cathode chamber.

DESCRIPTION OF THE FIGURES

These and other features, aspects, and advantages of the present invention will become better understood with reference to the following description and appended claims, where:

FIG. 1 is schematic representation of a suitable electrolysis cell for carrying out the process according to the invention.

DESCRIPTION

The invention relates to a process for the electrochemical preparation of chlorine from aqueous solutions of hydrogen chloride in an electrolysis cell, comprising at least one anode chamber and one cathode chamber, the anode chamber being separated from the cathode chamber by a cation exchange membrane, the anode chamber containing an anode and the cathode chamber containing an oxygen-consuming cathode, and the aqueous solution of hydrogen chloride being passed into the anode chamber and an oxygen-containing gas into the cathode chamber, and the absolute pressure in the cathode chamber being at least 1.05 bar.

As a result of the pressure in the cathode chamber being slightly increased according to the invention, the formation of hydrogen at the oxygen-consuming cathode is diminished and, in addition, the electrolysis voltage achieved is lower as compared to when the reaction is carried out under atmospheric pressure, corresponding to the ambient pressure, in the cathode chamber. It is surprising and was not to be expected that even a comparatively small increase in the pressure in the cathode chamber leads to a substantial reduction in the undesired evolution of hydrogen at the oxygen-consuming cathode and to lower electrolysis voltages, which in turn is advantageous with respect to the energy consumption.

For example, pure oxygen, a mixture of oxygen and inert gases, in particular nitrogen, or air can be used as the oxygen-containing gas. Pure oxygen, in particular having a purity of at least about 99% by volume, is preferably used as the oxygen-containing gas.

The stated pressure in the cathode chamber is an absolute value. Preferably, the pressure in the cathode chamber is from about 1.05 to about 1.5 bar, particularly preferably from about 1.05 to about 1.3 bar.

The pressure in the cathode chamber can be adjusted to the value of at least about 1.05 bar according to the invention, for example, if the oxygen-containing gas fed to the cathode chamber is backed up by means of a pressure-maintaining apparatus. A suitable pressure-maintaining apparatus is, for example, a liquid seal, by means of which the cathode space is blocked off. Throttling by means of valves is also a suitable method for adjusting the pressure in the cathode space.

In order to ensure sufficient contact between cation exchange membrane and oxygen-consuming cathode, a pressure which is from about 0.01 to about 1,000 mbar higher than the pressure in the cathode chamber is preferably established in the anode chamber.

The pressure in the anode chamber is particularly preferably from about 50 to about 500 mbar, very particularly preferably from about 200 to about 500 mbar, higher than the pressure in the cathode chamber.

The process according to the invention is preferably operated at a current density of at least about 3,500 $A/m^2$, particularly preferably at a current density of at least about 4,000 $A/m^2$, especially preferably at a current density of at least about 5,000 $A/m^2$.

The temperature of the aqueous hydrogen chloride solution fed in is preferably from about 30 to about 80° C., particularly preferably from about 50 to about 70° C.

The concentration of the hydrochloric acid in the electrolysis unit when carrying out the process according to the invention is preferably from about 5 to about 20% by weight, particularly preferably from about 10 to about 15% by weight. The spent hydrochloric acid in the electrolysis unit can be replenished by a hydrochloric acid fed to the electrolysis unit and having a concentration range of from about 8 to about 36% by weight.

The oxygen-containing gas is preferably fed in in an amount such that oxygen is present in excess, relative to the theoretically required amount. A 1.2- to 1.5-fold excess of oxygen is particularly preferred.

The process according to the invention is carried out in an electrochemical cell (electrolysis cell), the anode chamber of which is separated from the cathode chamber by a cation exchange membrane, the cathode chamber containing an oxygen-consuming cathode.

The electrolysis cell used may comprise, for example, the following components: an anode in an anode chamber, a cation exchange membrane which is pressed hydrostatically onto an oxygen-consuming cathode (OCC), which in turn is supported on a current distributor on the cathode side and thus electrically contacted, and a gas space on the cathode side (cathode chamber).

The aqueous solution of hydrogen chloride is passed into the anode chamber, and the oxygen-containing gas into the cathode chamber.

The choice of the oxygen-consuming cathode is not critical. The known oxygen-consuming cathodes, some of which are commercially available, may be used. However, oxygen-consuming cathodes which contain a catalyst of the platinum group, preferably platinum or rhodium, are preferably used.

Suitable cation exchange membranes are, for example, those comprising perfluoroethylene which contain sulfonic acid groups as active centers. Both single-ply membranes which have sulfonic acid groups of the same equivalent weights on both sides and membranes which have sulfonic acid groups having different equivalent weights on both sides are suitable. Membranes having carboxyl groups on the cathode side are also possible.

Suitable anodes are, for example, titanium anodes, in particular having an acid-resistant, chlorine-evolving coating.

The current distributor on the cathode side may consist, for example, of expanded titanium metal or noble metal-coated titanium.

A suitable electrolysis cell for carrying out the process according to the invention is shown schematically in FIG. 1.

The electrolysis cell 1 is divided by a cation exchange membrane 6 into a cathode chamber 2 having an oxygen-consuming cathode 5 and an anode chamber 3 having an anode 4. The oxygen-consuming cathode 5 rests on the cathode side of the cation exchange membrane 6. Behind the oxygen-consuming cathode 5 is a current distributor 7. Owing to the higher pressure in the anode chamber 3, the cation exchange membrane 6 is pressed onto the oxygen-consuming cathode 5 and this in turn onto the current distributor 7. In this way, the oxygen-consuming cathode 5 makes sufficient electrical contact and is sufficiently supplied with current. The pressure in cathode chamber 2 and anode chamber 3 is established in each case by a pressure-maintaining means 8. An aqueous solution of hydrogen chloride is passed into the anode chamber 3 via an HCl inlet 12, chlorine forming at the anode 4, flowing through the pressure-maintaining means 8 and being removed from the anode chamber 3 via the $Cl_2$ outlet 13. Oxygen-containing gas is passed via an $O_2$ inlet 9 into the cathode chamber 2, where it reacts with protons at the oxygen-consuming cathode 5 with formation of water, which protons diffuse from the anode chamber 3 into the oxygen-consuming cathode 5. The water formed is removed from the cathode chamber 2 together with the excess oxygen-containing gas via the pressure-maintaining means 8, the water formed being taken off via an $H_2O$ outlet 11 and the oxygen-containing gas via an $O_2$ outlet 10. It is also possible for the oxygen to be fed in from below and/or for the removal of water formed and oxygen-containing gas to be carried out separately, in each case via a separate pressure-maintaining means.

The invention is further described in the following illustrative examples in which all parts and percentages are by weight unless otherwise indicated. In the following examples, the process according to the invention is further explained, and the examples are not to be understood as restricting the general concept of the invention.

EXAMPLE 1

Comparative Example

The electrolysis was carried out in an electrolysis cell 1 divided into a cathode chamber 2 and an anode chamber 3, as shown schematically in FIG. 1 and explained in more detail above. The anode 4 used was an activated titanium anode having a size of 10 cm×10 cm. A aqueous solution of hydrogen chloride was fed to the anode chamber 3. The temperature of the aqueous solution of hydrogen chloride was 60° C. and the concentration 12–15% by weight. The cathode chamber 2 contained, as oxygen-consuming cathode 5, a gas diffusion electrode from the company E-TEK, type ELAT, which rested directly on a current distributor 7 in the form of an activated expanded titanium metal. Cathode chamber 2 and anode chamber 3 were separated by a cation exchange membrane 6 from the company DuPont, type Nafion® 324. Pure oxygen having a content of more than 99% by volume was passed at a temperature of 20° C. into the cathode chamber 2.

The electrolysis was operated at a pressure of 1.4 bar abs. in the anode chamber 3 and a pressure of 1 bar abs. in the cathode chamber 2, a voltage of 1.67 V and a current density of 6 000 $A/m^2$. The excess oxygen-containing gas was removed from the cathode chamber 2 together with the water formed. The concentration of hydrogen in this gas was determined by means of gas chromatography. The hydrogen concentration was 700 ppm after a duration of electrolysis of 10 minutes, increased steadily in the course of the electrolysis and was 1 600 ppm after a duration of an electrolysis of 3 hours.

EXAMPLE 2

Comparative Example

An electrolysis of an aqueous solution of hydrogen chloride was carried out as described in example 1, but the pressure in the anode chamber 3 was 1.15 bar abs. The hydrogen concentration was 700 ppm after a duration of electrolysis of 10 minutes, increased steadily in the course of the electrolysis and was 1 600 ppm after 3 hours.

EXAMPLE 3

An electrolysis of an aqueous solution of hydrogen chloride was carried out as described in Example 1, but the pressure in the cathode chamber 2 was 1.06 bar abs. and the resulting voltage at a current density of 6,000 A/m$^2$ was 1.62 V. The hydrogen concentration was 300 ppm and remained constant over the electrolysis period of several days.

EXAMPLE 4

Comparative Example

An electrolysis of an aqueous solution of hydrogen chloride was carried out as described in Example 1. The pressure in the anode chamber 3 was 1.4 bar abs., the pressure in the cathode chamber 2 was 1 bar abs., the voltage was 1.82 V and the current density was 7,000 A/m$^2$. After a duration of electrolysis of only 3 minutes, a hydrogen concentration of 8,000 ppm was measured.

EXAMPLE 5

An electrolysis of an aqueous solution of hydrogen chloride was carried out as described in Example 4, but the pressure in the cathode chamber 2 was 1.12 bar abs. and the resulting voltage at the chosen current density of 7,000 A/m$^2$ was 1.74 V. The hydrogen concentration was 600 ppm and remained constant over the total electrolysis period of several days.

Although the present invention has been described in detail with reference to certain preferred versions thereof, other variations are possible. Therefore, the spirit and scope of the appended claims should not be limited to the description of the versions contained therein.

What is claimed is:

1. A process comprising electrochemically preparing chlorine from an aqueous solution of hydrogen chloride in an electrolysis cell having (a) at least one anode chamber containing an anode, (b) at least one cathode chamber having (i) an oxygen-consuming cathode and (ii) a pressure that is at least about 1.05 bar, and (c) a cation exchange membrane for separating the anode and the cathode chamber, wherein an aqueous solution of hydrogen chloride passes into the at least one anode chamber and an oxygen-containing gas passes into the at least one cathode chamber.

2. The process according to claim 1, wherein the pressure in the cathode chamber ranges from about 1.05 to about 1.5 bar.

3. The process according to claim 1, wherein the pressure in the anode chamber ranges from about 0.01 to about 1,000 mbar higher than the pressure in the cathode chamber.

4. The process according to claim 3, wherein the pressure in the anode chamber is from about 50 to about 500 mbar higher than the pressure in the cathode chamber.

5. The process according to claim 1, wherein the cell operates at a current density of at least about 3,500 A/m$^2$.

6. The process according to claim 5, wherein the process is operated at a current density of at least about 5,000 A/m$^2$.

7. The process according to claim 1, wherein the oxygen-consuming cathode used contains a catalyst of the platinum group.

8. The process according to claim 1, wherein the cathode contains a platinum catalyst or a rhodium catalyst.

9. The process according to claim 1, wherein the cation exchange membrane comprises perfluoroethylene.

10. The process according to claim 9, wherein the cation exchange membrane contains sulfonic acid groups as active centers.

* * * * *